United States Patent [19]

Chenoweth

[11] Patent Number: 4,893,400

[45] Date of Patent: Jan. 16, 1990

[54] METHOD OF MAKING A REPAIRABLE TRANSFORMER HAVING AMORPHOUS METAL CORE

[75] Inventor: Terrence E. Chenoweth, Watkinsville, Ga.

[73] Assignee: Westinghouse Electric Corp., Pittsburgh, Pa.

[21] Appl. No.: 87,929

[22] Filed: Aug. 21, 1987

[51] Int. Cl.[4] ..... H01F 41/02

[52] U.S. Cl. ..... 29/606; 29/609; 336/217; 336/234

[58] Field of Search ..... 29/605, 606, 609; 336/212, 213, 216, 217, 234

[56] References Cited

U.S. PATENT DOCUMENTS 2,623,920 12/1952 Ford .

4,648,929 3/1987 Siman ..... 29/609 X 4,734,975 4/1988 Ballard et al. ..... 29/606

*Primary Examiner*—Carl E. Hall

*Attorney, Agent, or Firm*—Joyce L. Morrison

[57] ABSTRACT

A method of making a repairable transformer having an amorphous metal core 1 wherein three uncut legs of an annealed wound amorphous metal core are covered with an adhesive impregnated material 10 while leaving the cut leg, 6 and 7, and both adjoining radii uncovered. The adhesive is cured, causing the adhesive to bond to the core. The core joint is opened and coils 11 and 12 are placed over the legs that adjoin the cut leg. The core joint is closed and the edges of the joint and both adjoining radii are covered with a porous material. No adhesive bonds to the edges of the cut leg or to the edges of adjoining radii. The resulting transformer can be repaired by cutting away the porous material that covers the cut leg and the adjoining radii, opening the core joint, replacing a defective coil, reclosing the core joint, and resealing the cut leg as before.

8 Claims, 4 Drawing Sheets

METHOD OF MAKING A REPAIRABLE TRANSFORMER HAVING AMORPHOUS METAL CORE

TECHNICAL FIELD

The invention relates to transformers having amorphous metal cores, and particularly to such transformers having wound rectangular cores with one cut leg containing a core joint.

BACKGROUND OF THE INVENTION

Despite its high cost, amorphous metal is gradually replacing electrical grade steel in transformer cores because it is a lower loss material. A wound core transformer can be made from amorphous metal by winding an amorphous metal sheet into a core, cutting one leg of the core, and forming the metal into a rectangular shape. The amorphous metal is then annealed, which converts it into a very brittle material. At this point, the core, except for the cut leg, may be protected by the application of a resinous coating. This prevents damage to the core and the escape of broken fragments of amorphous metal into the transformer where they might cause shorts. The cut leg is opened, coils are placed over other legs of the core and the cut leg is closed and sealed. (See, for example, copending U.S. Pat. application Ser. No. 07/079,854, filed Jul. 30, 1987, titled "Preparation of Amorphous Metal Core for Use in Transformer," herein incorporated by reference.) The final assembly is accomplished by placing the core with the coils mounted over its legs into a tank of oil where it is tested at high voltage. If the transformer fails due to a defect in one of the coils, however, the core must be scrapped because the amorphous metal core cannot be disassembled without damage. While the percentage of defective transformers is very low, the high cost of the amorphous metal cores means that a significant loss is incurred when a core must be scrapped.

DISCLOSURE OF THE INVENTION

It is the main object of this invention to make transformers having amorphous metal cores repairable, so that if a coil of the transformer is defective it can be replaced without damaging the amorphous metal core.

I have discovered that transformers having amorphous metal cores can be made in such a way that they can be repaired without damage to the amorphous metal core. In this invention, the amorphous metal core is still encapsulated to prevent damage to the core and to prevent the escape of fragments from the core, but the encapsulation over the leg that is cut and the adjoining radii is not permitted to bond to the edges of the core or to the edges of adjoining radii. Thus, if a transformer made according to this invention is tested at high voltage and is found to contain a defective coil, the protective covering over the cut leg and the adjacent radii can be removed without damaging the amorphous metal core. The cut leg can be opened to permit the replacement of the defective coil. The cut leg is reclosed and is resealed. It is therefore no longer necessary to discard an expensive amorphous metal core when it is assembled with a defective coil.

Brief DESCRIPTION OF THE DRAWINGS

The invention will become more apparent by reading the following detailed description in conjunction with the drawings, which are shown by way of example only, wherein.

DESCRIPTION OF THE PREFERRED EMBODIMENTS

Figure 1:
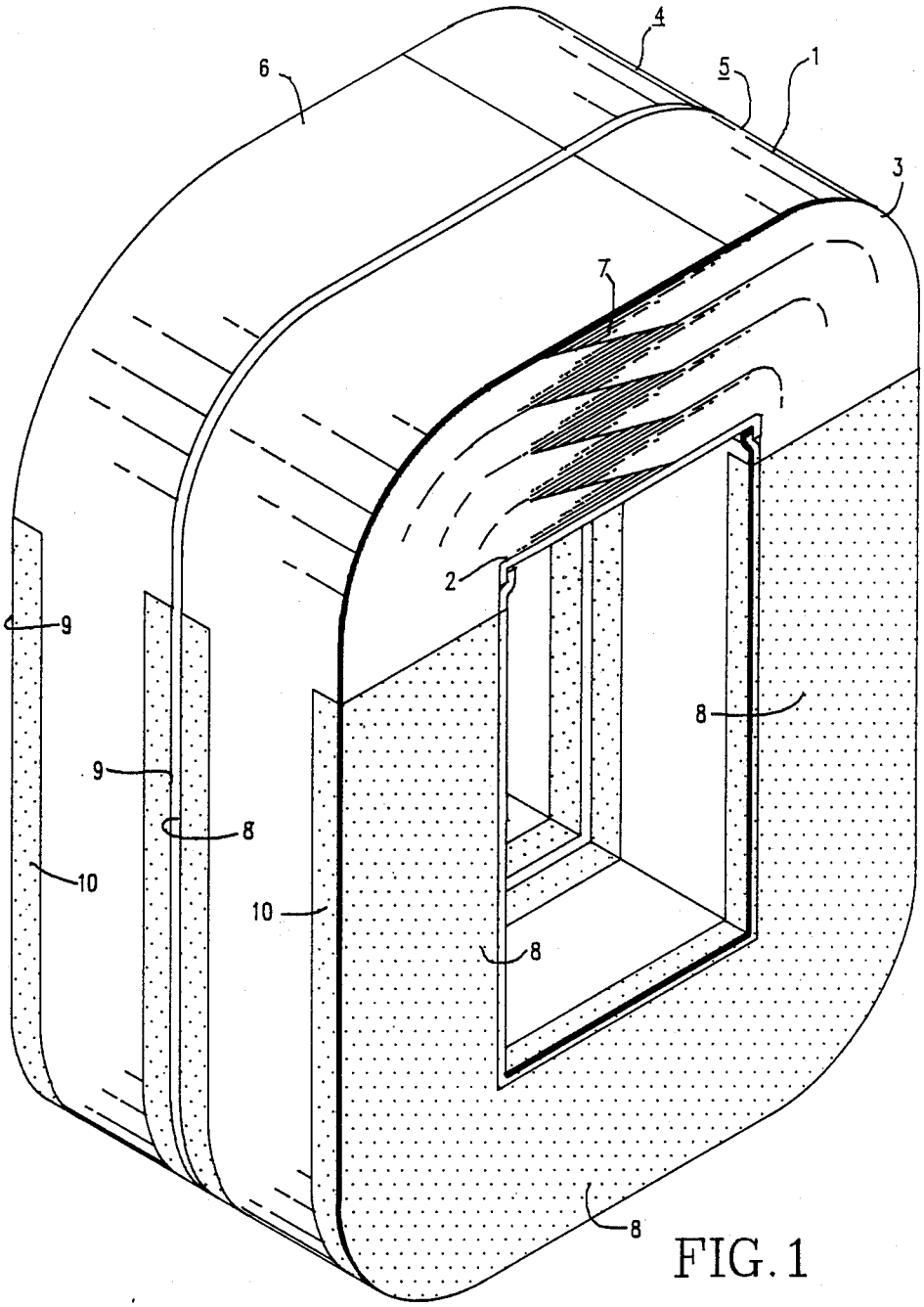
FIG. 1 is an isometric view showing a certain presently preferred embodiment of an amorphous metal core in an early stage of preparation according to the method of this invention.

In FIG. 1, an amorphous metal core 1 consists of two juxtaposed corelettes 4 and 5. Each corelette is formed over a carbon steel mandrel 2 and is placed in an electrical steel jacket 3 to further protect the amorphous metal. Each corelette was pressed into a rectangular shape and annealed after legs 6 and 7 were cut through. The edges 8 and 9 of the remaining legs of the corelette are covered with an adhesive-impregnated substrate 10, which extends over the edges and is cured to bond to the edges of the corelettes.

Figure 2:
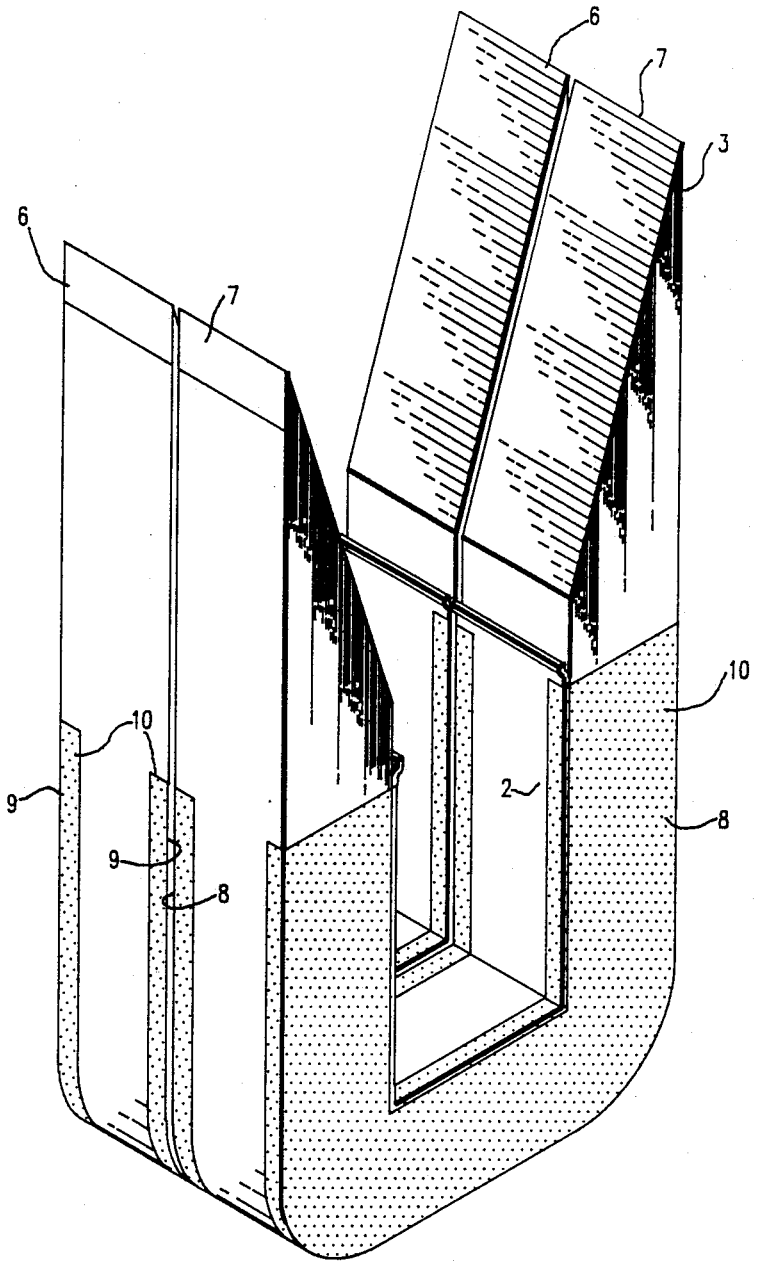
FIG. 2 is an isometric view showing the core of FIG. 1 with the cut leg open for the placement of coils over the two long legs.
Figure 3:
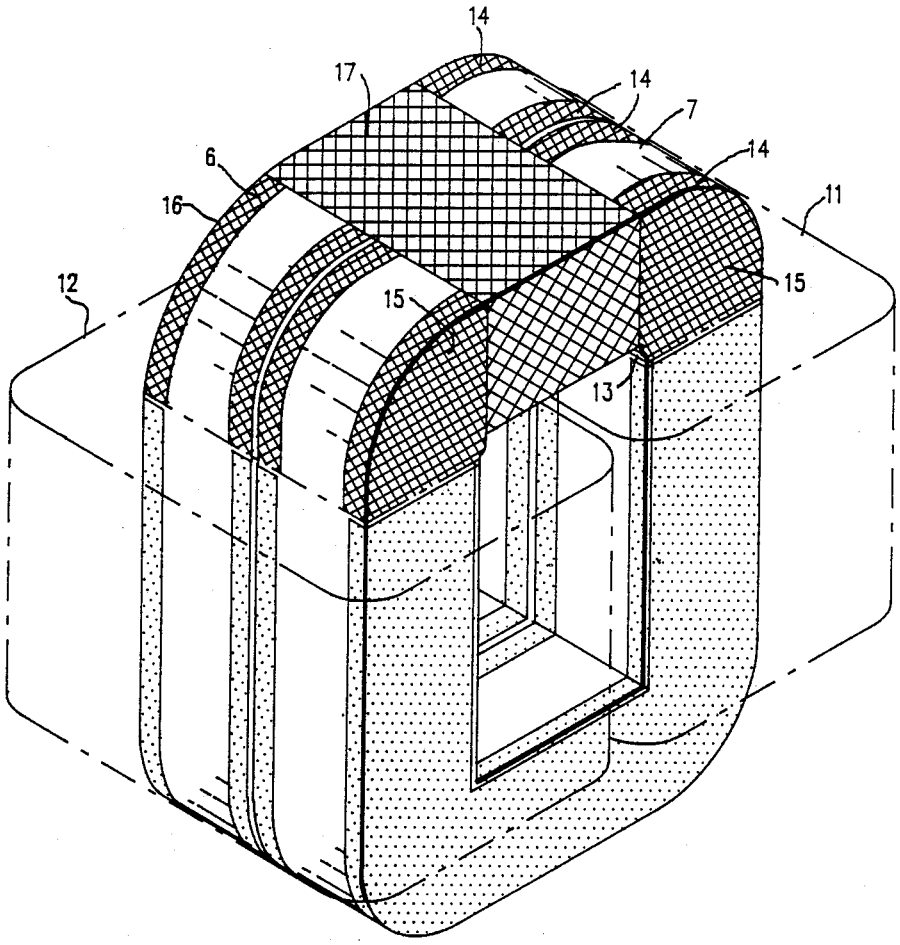
FIG. 3 shows the core of FIG. 2 with the cut leg closed after placement of coils over the long legs.

In FIG. 2, legs 6 and 7 have been opened and are positioned in a vertical direction for the acceptance of coils. In FIG. 3, coils 11 and 12 have been placed over the longer legs of core 1 and cut legs 6 and 7 have been reclosed. By means of a support (not shown) for coils 11 and 12, a space 13 has been provided above and below the coils to prevent stressing of the amorphous metal from contact with the coils. A cotton cloth 14 has been placed over the exposed edges of the cut leg and the adjacent radii 15 and 16, both outside and in between corelettes 4 and 5. Cotton cloth 14 overlaps the exposed edges of legs 6 and 7, and the overlapped portions are bonded to the legs with dabs of adhesive. (In an alternative procedure, which is presently preferred, cotton cloth 14 is applied during the step shown in FIG. 1 and is cut when the leg is opened as shown in FIG. 2). A substrate 17, similar or identical to the substrate 10, is wrapped over the cotton cloth and the cut leg at the position of the cut and is impregnated with adhesive in spots which are cured to hold it in place. The adhesive in the adhesive-impregnated substrate 17 bonds to cotton cloth 14 but does not seep through the cotton cloth and does not contact amorphous metal core 1.

Figure 4:
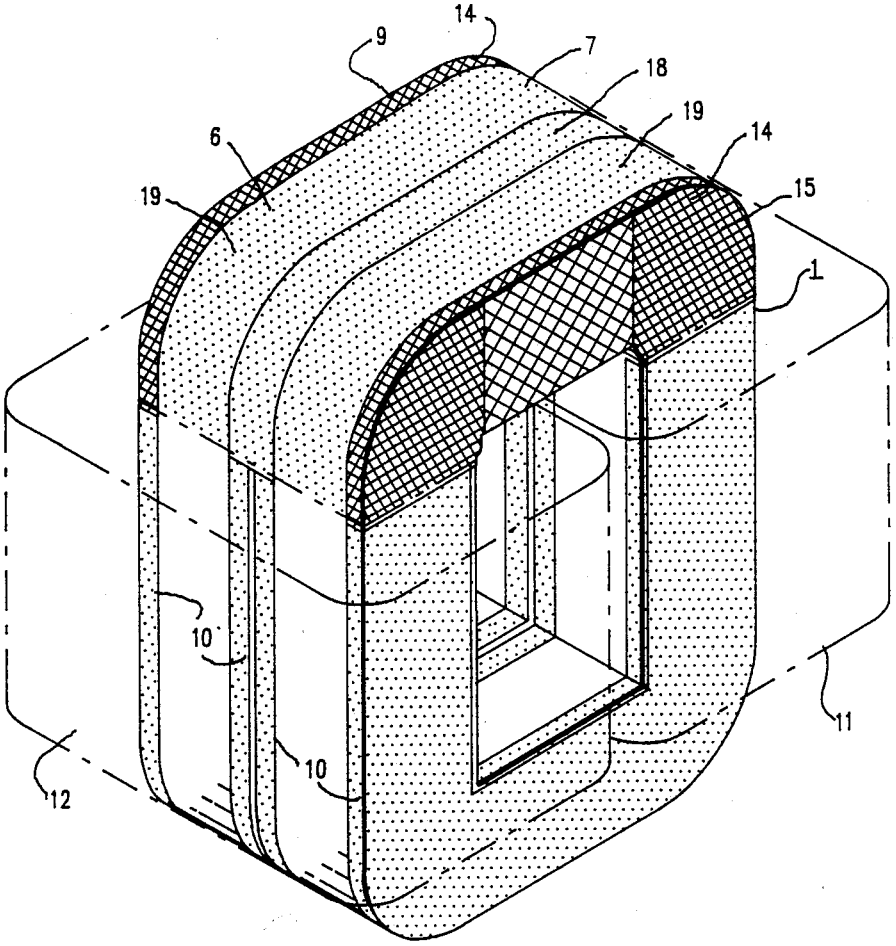
FIG. 4 shows the core of FIG. 3 with the cut leg sealed.

In FIG. 4 additional adhesive-impregnated substrate 18 is placed over the gap between the two corelettes, and additional adhesive-impregnated substrate 19 covers the space between adhesive-impregnated substrate 18 and cotton cloth 14. All the adhesive-impregnated substrates are then cured. Thus, while the adhesive bonds to jacket 3, to mandrel 12, and to the exposed edges of three legs of the amorphous metal, it never bonds to the edges of the amorphous metal on the cut leg or to the radii that adjoin the cut leg.

The assembly is then placed into an oil filled tank under vacuum, and is tested at high voltage. Should one of the coils 11 or 12 prove to be defective during the test, or, if two or more corelettes are used and one or more corelette is defective, the assembly is removed from the tank and the protective coverings 14, 17, 18, and 19 are cut away. The cut legs 6 and 7 of the corelettes can then be opened as shown in FIG. 2 so that the defective coil or corelette can be removed and replaced.

The procedures shown in FIGS. 3 and 4 are then repeated to reseal the cut leg.

The cotton cloth 14 permits air trapped in the core to be replaced with oil when the core is placed in oil under vacuum, but does not permit particles of amorphous metal to pass into the oil outside the coil. If the air pressure in the core is not releaved, it stresses the core and impairs its magnetic properties. Other air-porous materials that can be used, besides cotton cloth, include glass cloth, polyester cloth, and similar materials.

The substrate may consist of any type of adhesive-impregnable or porous material that has the required physical, chemical, and electrical properties. Suitable materials include glass and various organic fibrous materials such as polyesters, polyimides, and polyimides; glass is preferred for its. strength and good insulating properties. The substrate material is preferably woven for greater strength, though matted material may also be used. We have found by experiment that a substrate must be used, as an adhesive without a substrate does not have sufficient strength to hold the amorphous metal in place.

Examples of adhesives that can be used to impregnate the substrate material include UV curable, heat curable, or two-part resins that cure when the two parts are mixed. UV curable resins are preferred as they do not require a heating and cooling period and therefore are much faster to cure. Epoxy, polyester, phenolic, and other types of organic resinous materials can be used. The preferred resin is a UV curable modified epoxy urethane resin sold under the designation "F-13" by Westinghouse Electric Corporation and described in U.S. Pat. No. 4,481,258, herein incorporated by reference.

Any number of cores can be used in the transformer, and the invention is not intended to be limited to the two-legged core-form transformer shown in the drawings. For example, the invention is also applicable to shell form transformers, where a single coil (having two or more windings) encircles the butted legs of two cores. The amorphous metal core need not be rectangular, but may have any other suitable shape, such as cruciform (rectangular, but with a circular cross-section) or torus (circular or oval with a rectangular or circular cross-section). The amorphous metal core may consist of a single corelette, or of multiple corelettes where a transformer of greater width is desirable than the available width of amorphous metal. Amorphous metal is a commercially available material sold by Allied Signal Corporation under the trade designation "METGLAS" in a nominal thickness of about 1mil and a width of about 1 inch to about 8 inches. It is generally made of iron, boron, and silicon, and typically contains about 80% (by weight) iron, 14% boron, and 4% silicon, and may also contain carbon, nickel, and other elements. It is prepared by rapidly quenching a thin sheet of metal. (See U.S. Pat. No. 3,845,805, herein incorporated by reference, for additional information.) This invention is applicable to any type of transformer containing an amorphous metal core where the core is wound and cut, but the transformer is preferably a distribution oil-cooled transformer as the teachings of this invention are most applicable to this type of transformer.

I claim:

1. In a method of making a transformer having a wound amorphous metal core with a core joint in a cut leg, an improvement that makes said transformer repairable, characterized by completely enclosing said core in materials that prevents the escape of particles of said amorphous metal, where some of said materials, are impregnated with a curable adhesive, and curing said adhesive to bond materials impregnated therewith to said core, while preventing said adhesive from bonding to the edges of said cut leg and to the edges of the radii that adjoin said cut leg.

2. A method of making a repairable transformer having an annealed wound amorphous metal core with a core joint in a cut leg comprising:

(A) covering uncut legs of said core with a substrate impregnated with a curable adhesive, while leaving said cut leg and both adjoining radii uncovered;

(B) curing said adhesive, whereby said adhesive bonds to said core;

(C) opening said core joint;

(D) placing at least one coil over at least one leg that adjoins said cut leg;

(E) closing said core joint; and (F) covering the edges of said cut leg and both adjoining radii with a porous substrate without bonding said porous substrate to the edges of said cut leg or to the edges of radii that adjoin said cut leg.

3. A method according to claim 2 wherein said adhesive is UV curable.

4. A method according to claim 3 wherein said substrate is UV transparent.

5. A method according to claim 4 wherein said substrate is woven glass.

6. A method according to claim 2 wherein said porous substrate is cotton cloth.

7. A method according to claim 2 wherein said core is on a steel mandrel and is enclosed in a steel jacket.

8. A method according to claim 2 wherein said core is rectangular, h as a rectangular cross-section and a coil is placed over each leg that adjoins said cut leg.

* * * * *